US007168673B1

(12) United States Patent
Piemonte et al.

(10) Patent No.: US 7,168,673 B1
(45) Date of Patent: Jan. 30, 2007

(54) POLE STABILIZATION AND SUPPORT SYSTEM AND KIT

(76) Inventors: Robert B. Piemonte, 16 Crescent Dr., Bridgewater, MA (US) 02340; Harvey N. Berube, 471 S. Precinct St., East Taunton, MA (US) 02718

( * ) Notice: Subject to any disclaimer, the term of this patent is extended or adjusted under 35 U.S.C. 154(b) by 206 days.

(21) Appl. No.: 10/880,743

(22) Filed: Jun. 28, 2004

Related U.S. Application Data

(60) Provisional application No. 60/483,565, filed on Jun. 27, 2003.

(51) Int. Cl.
*E02D 37/00* (2006.01)

(52) U.S. Cl. ..... 248/544; 248/218.4; 52/514; 52/737.5; 405/216

(58) Field of Classification Search ..... 248/544, 248/218.4, 219.1, 219.3, 227.3, 230.8, 230.1; 52/514, 40, 736.4, 737.5, 101, 170; 47/32.4, 47/32.5; 405/216; 285/373
See application file for complete search history.

(56) References Cited

U.S. PATENT DOCUMENTS 2,262,873 A * 11/1941 Wise ..... 40/607.12
3,069,189 A * 12/1962 Hollaender ..... 403/385
3,233,922 A * 2/1966 Evans ..... 285/236
3,359,017 A * 12/1967 Schaub ..... 285/236
3,362,124 A * 1/1968 Cravens et al. ..... 52/514
3,565,468 A * 2/1971 Garrett ..... 285/373
3,999,399 A * 12/1976 Maurer ..... 405/215
4,068,483 A * 1/1978 Papworth ..... 405/216
4,101,151 A * 7/1978 Ferguson ..... 285/236
4,172,607 A * 10/1979 Norton ..... 285/236
4,471,979 A * 9/1984 Gibb et al. ..... 285/373
4,708,373 A * 11/1987 Morriss, Jr. ..... 285/133.21
5,088,672 A * 2/1992 Neuendorf et al. ..... 248/218.4
5,499,430 A * 3/1996 Strazar ..... 24/279
5,765,876 A * 6/1998 Bridges ..... 285/15
6,276,726 B1 * 8/2001 Daspit ..... 285/15
6,322,863 B1 * 11/2001 Kubicky ..... 428/34.5
6,863,312 B1 * 3/2005 Liebst ..... 285/23

OTHER PUBLICATIONS

Asset Management for the Pole Plant a 5-Step Strategy, product literature, Osmose, Inc., Buffalo, NY 14209, (2001).

* cited by examiner

*Primary Examiner*—Korie Chan
(74) *Attorney, Agent, or Firm*—Lowrie, Lando & Anastasi, LLP

(57) ABSTRACT

A pole support system comprises a metal sleeve that generally conforms to an outer surface of the pole; an elastic liner disposed between the metal sleeve and the pole; and a clamping band that circumscribes and compresses the metal sleeve over the elastic liner against the pole. A pole reinforcement or repair kit comprises a sleeve having a generally axial opening opposite a generally flat rear wall, the generally flat rear wall framed on two sides by generally arcuate side walls, the sleeve lined by an elastic layer; and a clamping band having an adjustable circumference that, in use, will be placed to circumscribe and compress the metal sleeve over the elastic liner against the pole.

65 Claims, 10 Drawing Sheets

POLE STABILIZATION AND SUPPORT SYSTEM AND KIT

RELATED APPLICATIONS

This application claims priority under 35 U.S.C. § 119(e) to U.S. Provisional Application Ser. No. 60/483,565, entitled "UTILITY POLE REPAIR SYSTEM," filed on Jun. 27, 2003, which is herein incorporated by reference in its entirety.

BACKGROUND OF INVENTION

The present invention relates generally to stabilization, support, repair and clamping systems and kits and other mounted supports, supported appliances, transformers, connections, etc. used in connection with poles. More particularly, the present invention relates to such systems and kits used in connection with utility poles of various materials and geometries, especially, but no limited to, wooden utility poles having generally circular cross sections.

Utility poles, especially those made of pre-stressed concrete or wood, are considered to be durable, reliable components of the outside physical plant of various utilities, such as electric systems and telephone systems. High reliability and durability is very desirable in utility poles, and other applications of vertical support, because such poles are often used in locations or in ground where they are difficult and expensive to repair or replace. The difficulty and expense can arise from difficulties in reaching a broken or damaged pole, the condition of the ground after a break and the cost of sending one or more repair crews and equipment to remote locations which may be experiencing adverse conditions such as bad weather, fire, flood, earthquakes, landslides, etc.

Despite their high reliability and durability, utility poles are susceptible to various types of damage. Wooden poles may be susceptible to "dry rot" or bacterial attack from the ground. Similarly, concrete poles may be susceptible to chemical leaching and thus weakening from materials naturally found in the ground. Other poles may be susceptible to other forms of natural attack, including chemical, wind, other storm forces, ice and snow accumulation, etc. Poles are frequently placed along roadsides, making them susceptible to damage by vehicle impact, snowplow impact, or simply impacts from objects kicked up by a snowplow or other vehicle.

Repair or replacement is conventionally effected by sending a crew to the affected pole, disconnecting all of the utility facilities connected to the pole, e.g. wires and transformers, removing the pole from the ground and placing a new pole in the ground. Sometimes, the old pole is not removed, but is merely reinforced by a new, adjacent pole or other ad hoc temporary repairs.

Also, when a pole is subjected to an impact, sometimes the damage is not immediately evident. For example, if a pole to which a transformer is clamped receives a strong impact, the pole itself may not shatter or break. However, mechanical resonances set up over the length of the pole, with the transformer itself providing the resonating mass, can cause extraordinary stress to the transformer clamping apparatus. The clamping apparatus can be weakened or broken, ultimately resulting in a dangerous condition where the transformer falls to the ground causing an environmental hazard, personal or property injury, or even death.

SUMMARY OF INVENTION

What is desired is an inexpensive, reusable support system that can be applied to a pole by a minimal sized crew after the pole has received some type of damage as an interim repair until the pole can more conveniently be replaced, in due course. Also desired is an inexpensive, reusable support system that can be applied to a pole that may be at risk of an impact or other damage, before the impact or other damage, to prevent or mitigate damage. Yet further desired is an inexpensive, reusable support system that can be applied to a pole holding a transformer, or other massive object, that can reduce or prevent mechanical resonances in the pole from causing damage to the pole or to the apparatus holding the massive object to the pole when those mechanical resonances are excited by an impact or the like.

According to aspects of embodiments of the invention, a pole support system comprises a metal sleeve that generally conforms to an outer surface of the pole; an elastic liner disposed between the metal sleeve and the pole; and a clamping band that circumscribes and compresses the metal sleeve over the elastic liner against the pole. The metal sleeve may further comprise a generally flat back portion, and may yet further comprise two generally arcuate wings, one disposed to each side of the generally flat back portion. The generally arcuate wings may comprise a series of adjacent linear breaks separated by narrow flats. One of the generally arcuate wings may further comprise a bevel lip bent at an angle inwardly and the other of the generally arcuate wings may comprise a generally unbent slip lip, whereby when the sleeve is applied, the slip lip passes over the bevel lip at an overlap.

The sleeve can also include other features, such as at least one nail hole for receiving a nail whereby the sleeve is temporarily suspended during installation, at least one lifting slot whereby the sleeve is lifted to an installation location, and/or at least one grounding hole for receiving an earth ground. The sleeve may be 2 feet long, and may be up to about 4 feet, about 6 feet, about 8 feet or even about 12 feet long. The sleeve may further comprise weather resistant steel, for example stainless steel, galvanized steel, powder coated steel or polymer coated steel.

According to various aspects of embodiments of the invention, the elastic liner may have various features. The elastic liner may have about a 50–80 durometer. The elastic liner may have a coefficient of friction sufficient to hold the system in place when clamped to a pole. The elastic liner may be about ¾ inches thick. The elastic liner may be resistant to natural deteriorating agents, for example the elastic liner may be sufficiently porous to permit water to flow through the elastic liner, the elastic liner is resistant to biologic action, the elastic liner may be resistant to insect damage, the elastic liner may be resistant to bacteriologic damage and the elastic liner may be resistant to fungal damage. The elastic liner may comprise bonded crumb rubber.

According to various aspects of embodiments of the invention, the clamp may have various features. The clamp may be adjustable to accommodate poles having different circumferences and perimeter lengths. In embodiments where the generally arcuate wings meet at a joint or opening, which may be secured or not, and wherein the clamp has an opening drawn together by an adjustable fastener, the opening of the clamp and the joint or opening may be arranged to be unaligned when assembled. The clamp may be weather resistant, for example comprising powder coated steel or polymer coated steel.

According to other aspects of embodiments of the invention, a pole reinforcement or repair kit comprises a sleeve having a generally axial opening opposite a generally flat rear wall, the generally flat rear wall framed on two sides by generally arcuate side walls, the sleeve lined by an elastic layer; and a clamping band having an adjustable circumference that, in use, will be placed to circumscribe and compress the metal sleeve over the elastic liner against the pole. The generally arcuate wings may comprise a series of adjacent linear breaks separated by narrow flats. One of the generally arcuate wings may further comprise a bevel lip bent at an angle inwardly and the other of the generally arcuate wings may comprise a generally unbent slip lip, whereby when the sleeve is applied, the slip lip passes over the bevel lip at an overlap.

The sleeve can also include other features, such as at least one nail hole for receiving a nail whereby the sleeve is temporarily suspended during installation, at least one lifting slot whereby the sleeve is lifted to an installation location, and/or at least one grounding hole for receiving an earth ground. The sleeve may be 2 feet long, and may be up to about 4 feet, about 6 feet, about 8 feet or even about 12 feet long. The sleeve may further comprise weather resistant steel, for example stainless steel, galvanized steel, powder coated steel or polymer coated steel.

According to various aspects of embodiments of the invention, the elastic liner may have various features. The elastic liner may have about a 50–80 durometer. The elastic liner may have a coefficient of friction sufficient to hold the system in place when clamped to a pole. The elastic liner may be about ¾ inches thick. The elastic liner may be resistant to natural deteriorating agents, for example the elastic liner may be sufficiently porous to permit water to flow through the elastic liner, the elastic liner is resistant to biologic action, the elastic liner may be resistant to insect damage, the elastic liner may be resistant to bacteriologic damage and the elastic liner may be resistant to fungal damage. The elastic liner may comprise bonded crumb rubber.

According to various aspects of embodiments of the invention, the clamp may have various features. The clamp may be adjustable to accommodate poles having different circumferences and perimeter lengths. In embodiments where the generally arcuate wings meet at a joint or opening, which may be secured or not, and wherein the clamp has an opening drawn together by an adjustable fastener, the opening of the clamp and the joint or opening may be arranged to be unaligned when assembled. The clamp may be weather resistant, for example comprising powder coated steel or polymer coated steel.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
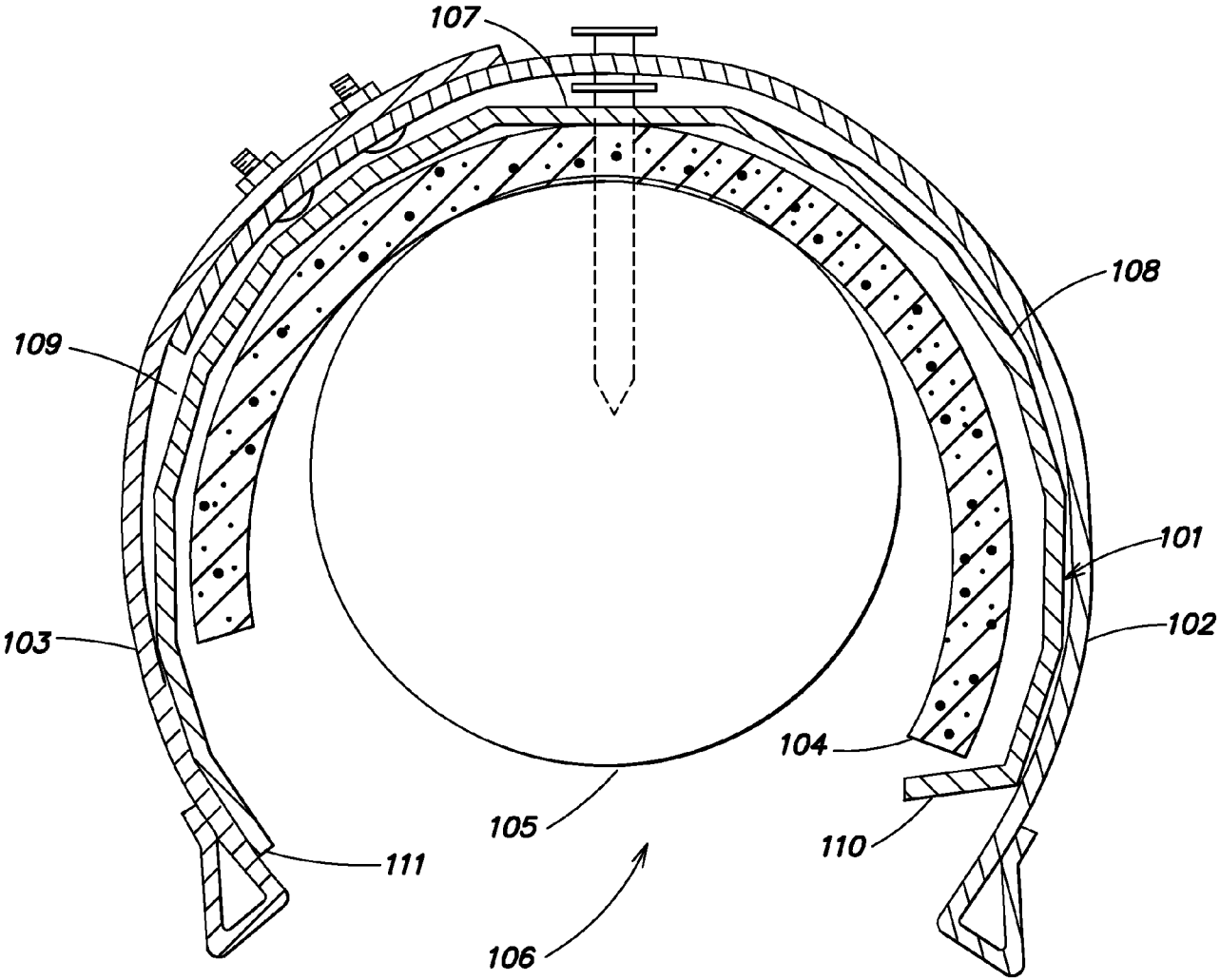
FIG. 1 shows a plan or top view of a sheath, having a cushioning layer and a metal strap, with the sheath nailed to a pole.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Aspects of embodiments of the invention include a pole stabilization, support or repair system or kit that is safe and inexpensive to apply, and that is reusable. As discussed above, in the Summary of Invention, the system or kit includes a sleeve, lined with an elastic member, the sleeve and liner held in place when in use by an adjustable clamp. The components are all made from materials that are inexpensive, readily available from stock or recycled sources. As will be explained, the system can be quickly installed by a crew of one or two at ground level with the assistance of a small crane or lifting aid above six feet.

Figure 2:
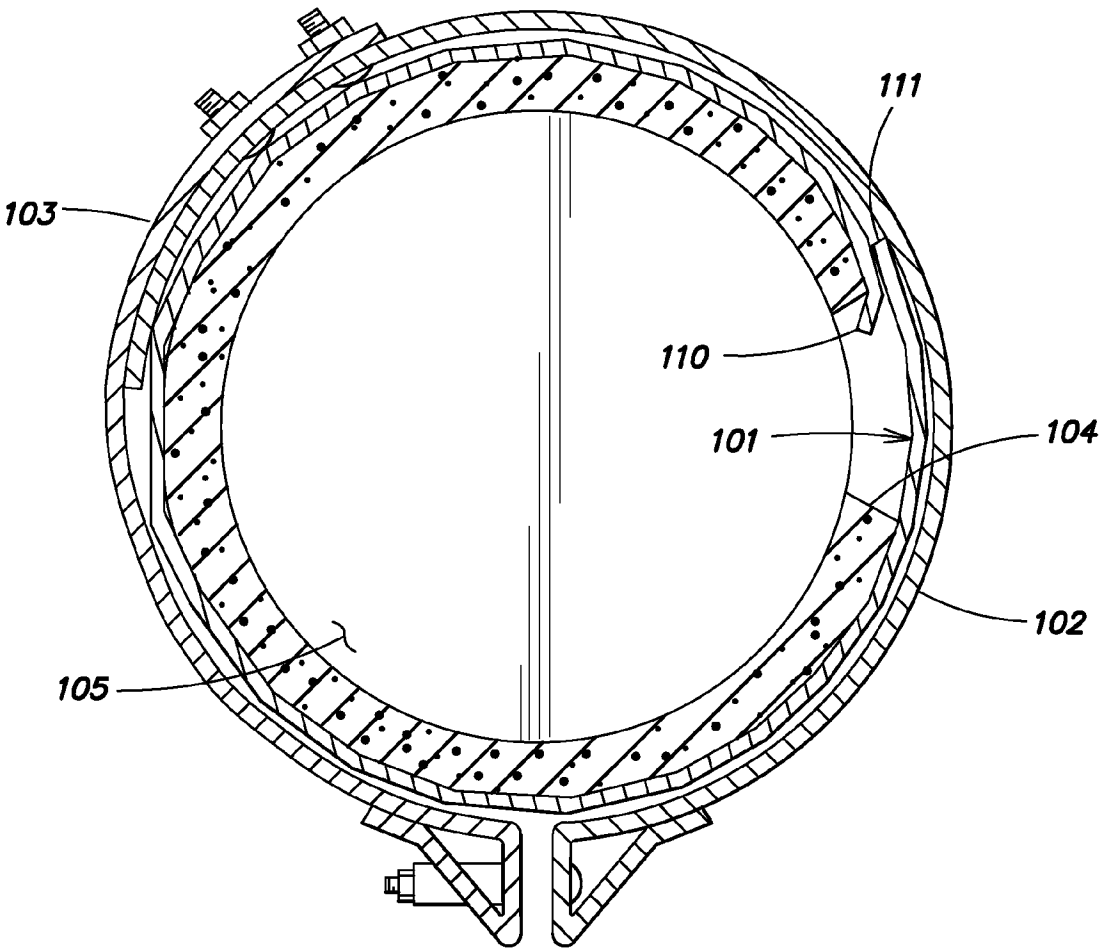
FIG. 2 shows a plan or top view of a sheath, having a cushioning layer and a metal strap that clamps the sheath into a closed position around a pole.
Figure 3:
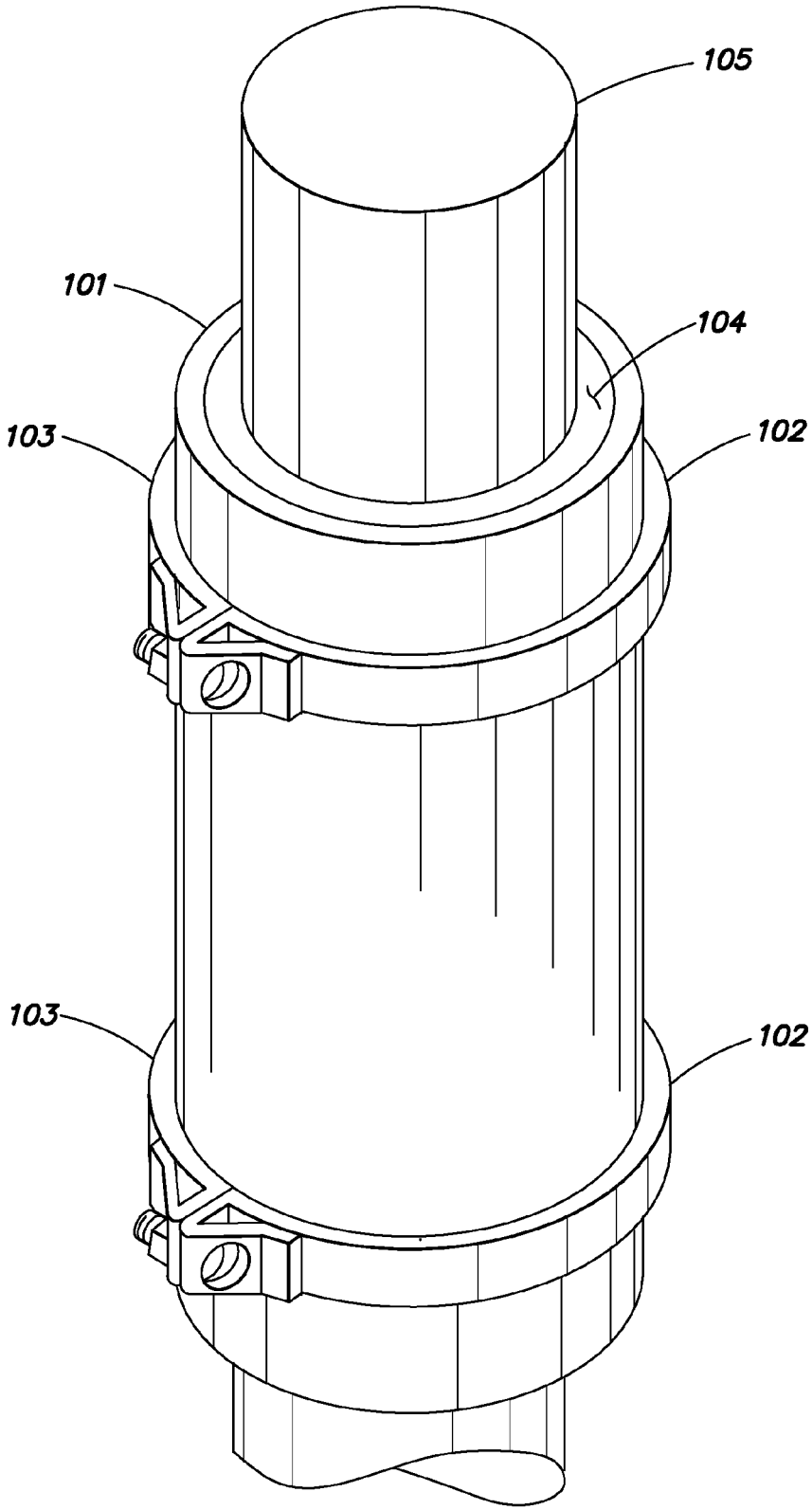
FIG. 3 shows a front perspective view of a sheath, having a cushioning layer and a metal strap that clamps the sheath into a closed position around a pole.

Reference is now made to FIGS. 1, 2 and 3.

The sleeve 101 is the strength member that will distribute the forces applied by the clamp 102, 103 through the elastic member 104 to the pole 105 to provide the desired stabilization or support. The elastic member 104, through its resilience, absorbs the energy of impacts to the pole 105, and flexibly absorbs movements of an underlying defect due to prior damage that has been stabilized when subjected to environmental stresses such as compression, tension and torsion, such as wind. After the system has been temporarily secured, as will be explained below, the clamp 102, 103 is applied to secure the system for an extended period of time. Each of these elements of the system are now described in detail, after which it is explained how the system is applied to a pole, and some further advantages and applications of the system are explained.

The sleeve 101 is preferably made of a strong material that will have some degree of elasticity when used in practical applications, as explained below. Sleeves suitable for use with utility poles, especially wooden utility poles, are preferably made of 12 or 14 gauge steel, with 14 gauge steel being more preferred. The invention is not, however, limited to a particular gauge of steel. Since wooden utility poles come in a wide range of diameters, and often are tapered, the sleeve should have sufficient elasticity that a sleeve having a fixed axial opening 106 can be worked around a pole having any of a range of diameters and then tightened as described below, without undergoing permanent deformation.

In order to prevent oxidation, the steel can be galvanized or otherwise suitably coated for protection. Alternate suitable coatings may include a flexible powder coating or chip-resistant polymer coating. In order to sustain multiple reuses and resist environmental assault, the coating should be flexible, chip-resistant and well-bonded to the underlying steel.

The sleeve may be made in any suitable length. Naturally, it will be preferred by contractors using the system to stock a limited number of standard-sized kits, for example including sleeves of 4, 6, 8 and 12 foot lengths.

The sleeve 101 has a substantially flat back 107 and two generally arcuate wings 108, 109. The flat back defines an elastic spring that provides an opening force to maintain an axial opening 106 of the sleeve sufficiently wide to permit the sleeve 101 to be worked around poles of various diameters. After the sleeve 101 has been used, and when it is later unclamped, the flat back 107 will again open the axial opening 106 of the sleeve to permit the sleeve to be removed from the pole and subsequently reused. The arcuate wings 108, 109 roughly trace the circumference of the poles to which the sleeve is designed to be applied. The arc of the wings should be defined by a radius slightly larger than the largest pole for which the sleeve is designed, so that the wings, like the flat back, are slightly flexed as the sleeve is tightened around the pole.

The arcuate wings 108, 109 can be made by any suitable technique, such as roll forming, progressive dies or, as preferred, by a series of parallel breaks at small angles, separated by thin, flat strips, approximating a smooth arc. For very long sleeves, such as those 12 feet long, or longer, the preferred method provides additional strength. In any case, it is a very low cost method of manufacture in the expected volumes required.

The edges of the arcuate wings that face each other to form the axial opening are shaped as follows. The edge of one arc 108 is bent inwardly to form an angled bevel 110. The opposing arc simply continues right to its edge; this edge is referred to as a slip edge 111. When the sleeve 101 is closed around a pole 105, the slip edge 111 is guided by the bevel 110 over the outside of the opposing arc if the pole is of a small enough diameter that there is no gap between the edges when the sleeve is closed.

Figure 4:
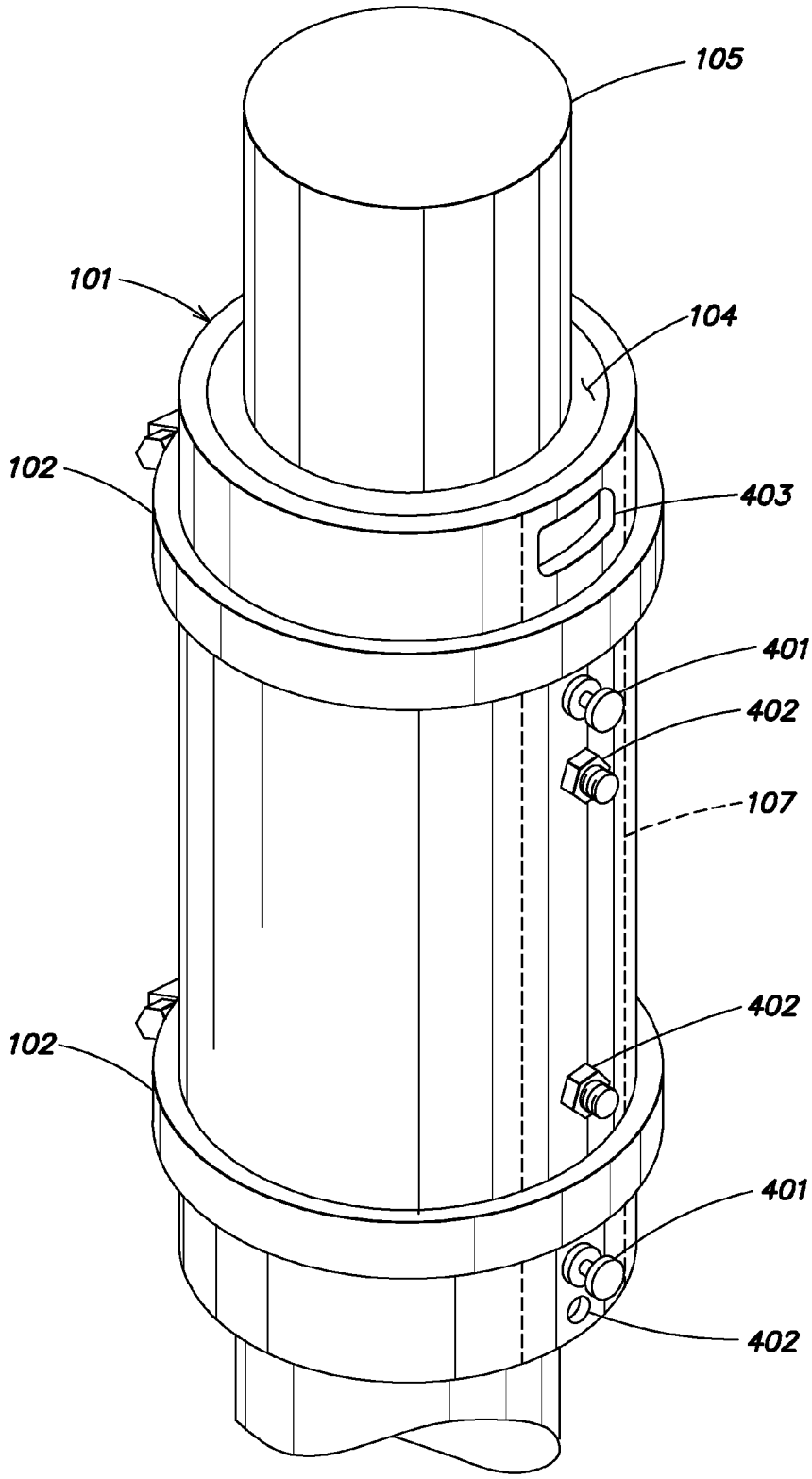
FIG. 4 shows a rear perspective view of a sheath, having a cushioning layer nailed to a pole, and a metal strap that clamps the sheath into a closed position around the pole.
Figure 5:
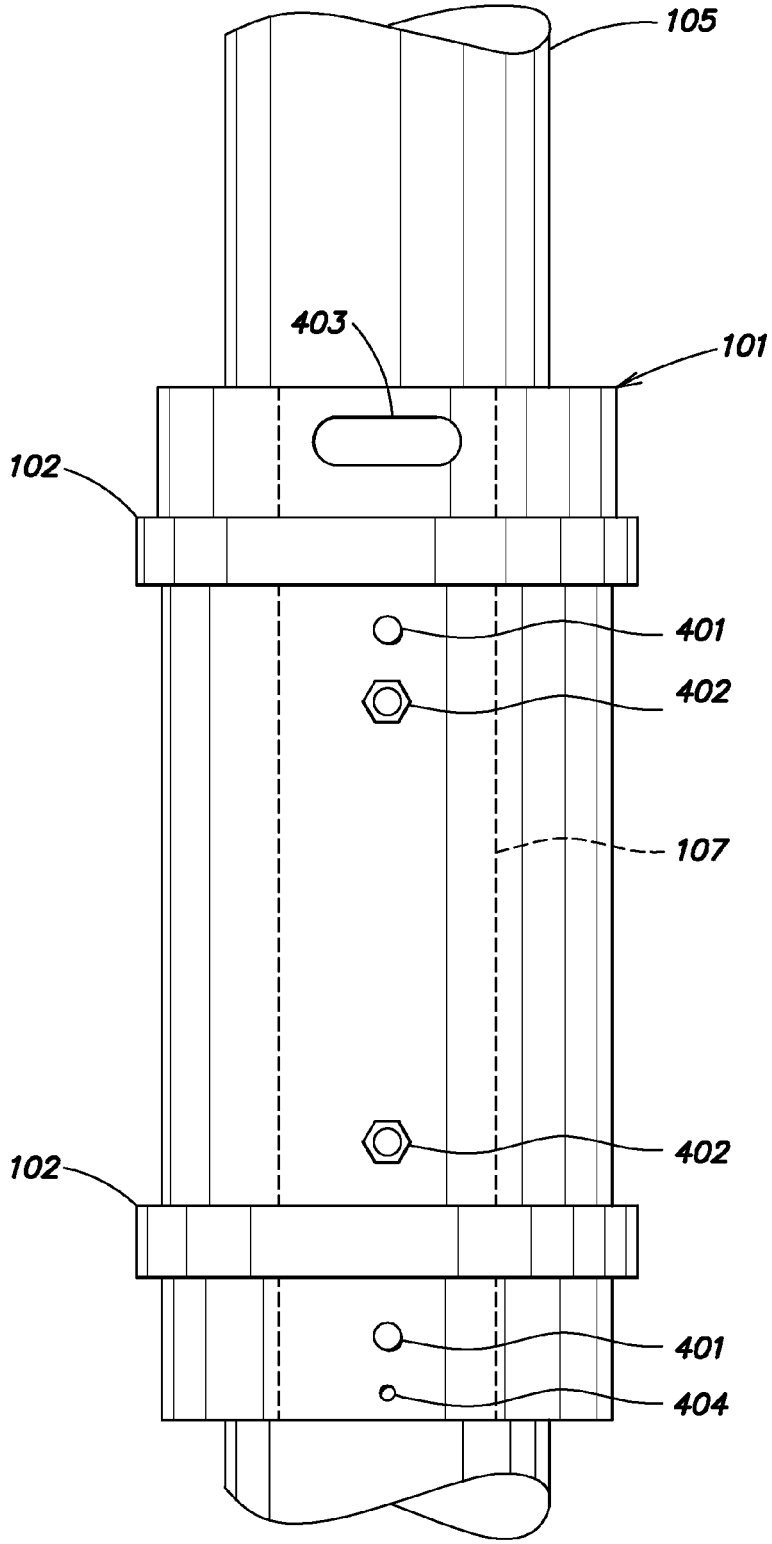
FIG. 5 shows a rear elevation view of a sheath, having a cushioning layer, nailed to a damaged utility pole, and a metal strap that clamps the sheath into a closed position around the pole.
Figure 7:
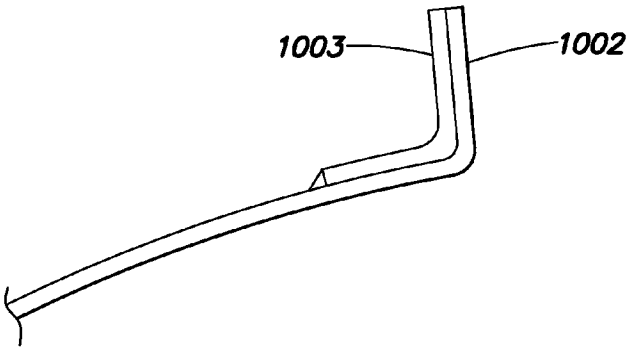
FIG. 7 shows a top view of the strap flange with reinforcement by providing a separate bent metal piece that is welded to the outside surface of the flange and strap.
Figure 9:
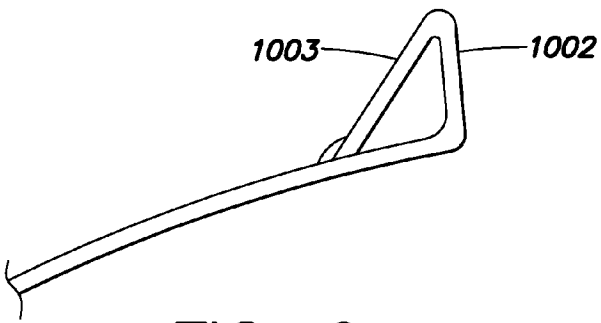
FIG. 9 shows a top view of the strap flange with reinforcement bending back the end of the strap to a brace position and welding the end in place.
Figure 6:
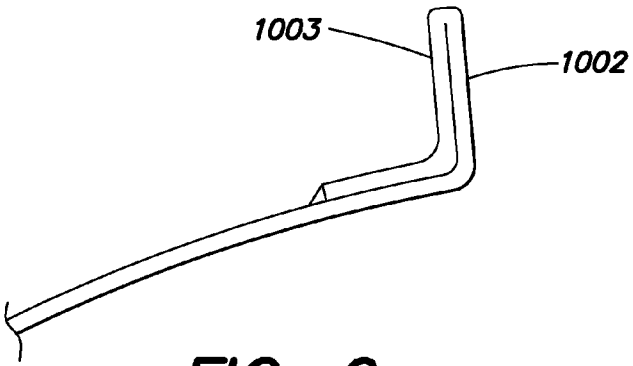
FIG. 6 shows a top view of the strap flange with reinforcement by bending back the end of the strap and welding it to the flange and strap.
Figure 8:
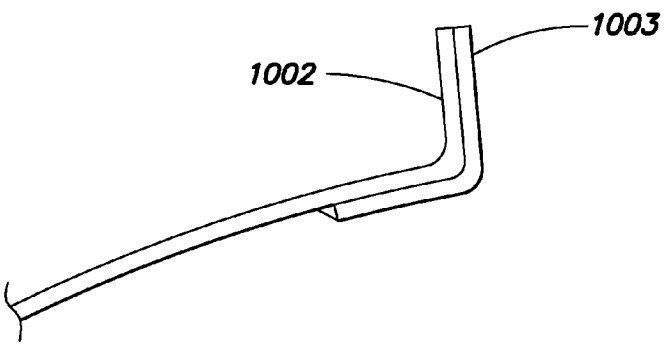
FIG. 8 shows a top view of the strap flange with reinforcement by providing a separate bent metal piece that is welded to the outside surface of the flange and strap.

The sleeve 101 is punctured in one or more locations, as now described in connection with FIGS. 4 and 5, by any suitable method, to provide a number of useful features. Preferably, each of the punctures is made in the flat back 107, in order to maximize their utility while minimizing the impact of the punctures on the strength of the sleeve 101.

At least one of the punctures should be a hole having a size suitable to receive a nail 401 for temporarily securing the sleeve to the pole at the location where it is to be installed. Preferred are 16P galvanized duplex nails, also known as double-headed nails, because duplex nails are easy to remove when no longer needed. Since the nails are only a temporary measure, used for safety when installing the system, they should be easy to remove when no longer needed.

At least one of the punctures should be a hole having a size suitable to receive a fastener 402 to hold the elastic layer to the inside of the sleeve. Although other means and methods of fastening the elastic layer to the sleeve, including clips, adhesive and friction could be used, one or two mushroom-head screws are preferred because this type of fastening combines a degree of permanence with a degree of sliding and flexing freedom that allows the elastic layer to conform to both the inside of the sleeve and the outside of the pole without wrinkling or other undesired stress.

At least one of the punctures should be a hole or slot 403 suitable for receiving a hoist hook or chain, so that the sleeve and elastic layer (attached to the inside of the sleeve) can be hoisted into place, where the sleeve is temporarily held there by the duplex nails mentioned above. Having a hoist hole or slot 403 permits the system to be installed by a crew as small as a single person, using a hoist to assist with lifting the system into place. The size, shape and orientation of the hoist hole may vary depending on the desire lifting apparatus.

Finally, at least one of the punctures should be a hole 404 for receiving an earth ground. In installations where an earth ground is desired or necessary, there may be provided a conductive stake driven into the ground, to which a wire is attached. The wire is then attached to the provided hole 404 in the sleeve by any suitable fastener.

The elastic layer 104 is preferably a ¾ inch sheet of bonded crumbed rubber, for example made from recycled tires. Any other suitable elastic material could be used, however, bonded crumbed rubber of the following description has several advantages, as will be noted. In some applications, such as where the elastic layer 104 is likely to be subject to long-term exposure to oil, other elastic materials may be more suitable.

Bonded crumbed rubber has a high coefficient of friction, which assists with holding the system in place once installed. The high coefficient of friction also helps keep broken parts of a pole from pulling out of the stabilization and support system under normal use stresses, holding the parts of a broken pole in alignment, while allowing stress movement.

Bonded crumbed rubber with a modulus of elasticity of about 50–80 durometer has sufficient elasticity to compensate for differential expansion and contraction of the various components with temperature variations over time and to absorb the energy of future impact stress, wind stress, and the like. The elasticity of the elastic layer also helps spread the clamping force applied to the sleeve to all parts of the pole roughly equally because the elastic layer conforms on the one side to the inside of the sleeve and on the other to the surface of the pole, even if the pole has surface irregularities. When removed from an installation, a ¾ inch sheet of bonded crumbed rubber of 50–80 durometer will substantially return to its original form upon release of the compression forces.

Bonded crumbed rubber can further be manufactured to have durability and resistance to degradation by common environmental elements in typical applications. For example, bonded crumbed rubber can be made with sufficient porosity to allow water to percolate through without collecting in the elastic layer. Thus, ice will be less likely to form between the sleeve and pole, particularly in the interstices of the elastic member, reducing stress on the system. Moreover, crumbed rubber is naturally resistant to bacteria, fungus and insects, properties that can be easily enhanced with suitable additives.

Figure 13:
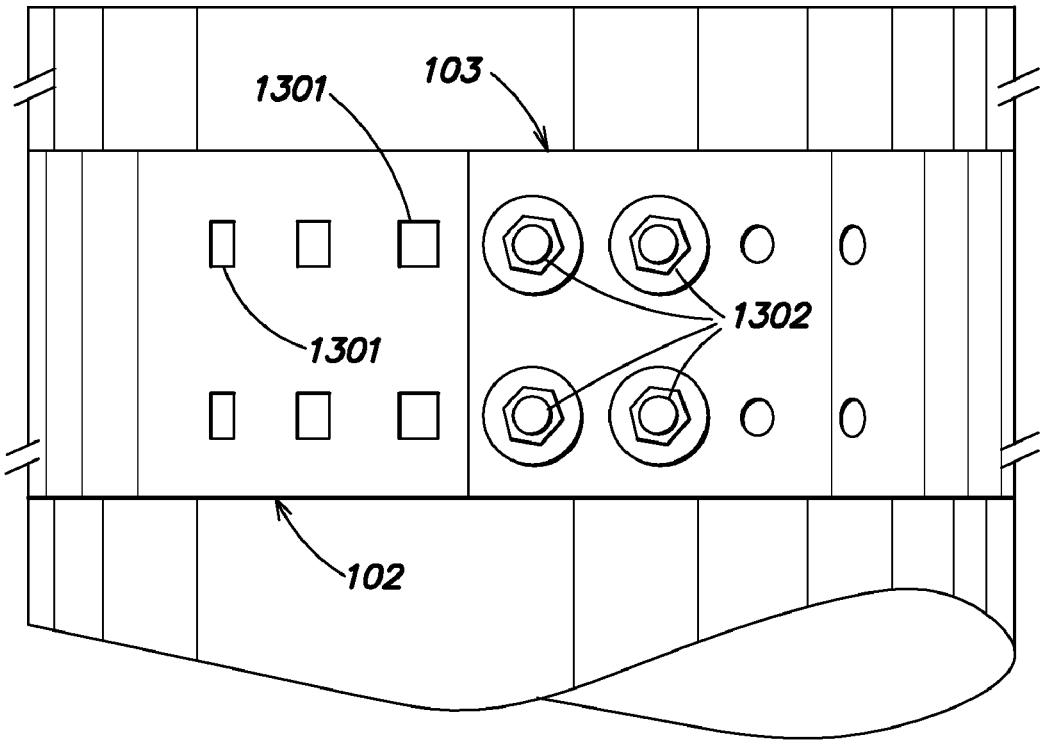
FIG. 13 shows a rear view of the strap and the bolt system by which the two halves of the strap are joined at the rear.

The clamp includes two curved steel strips about 2–5 inches wide. One end of each strip has one or more holes for joining the strips together into a clamp configuration. Preferably, as shown in FIG. 13, two rows of plural holes 1301 are provided. Four small carriage bolts 1302 inserted from the inside join the strips into one clamp strap of the proper length for the pole to which the sleeve is to be applied.

Figure 10:
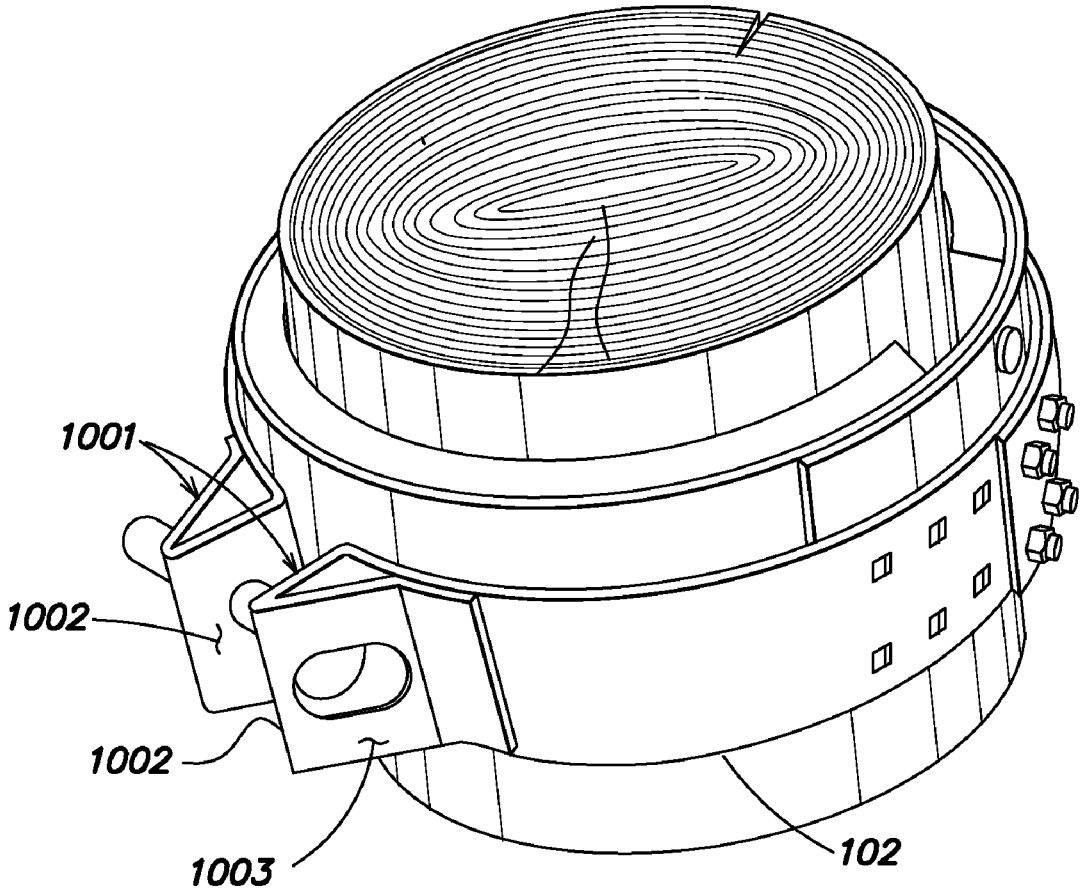
FIG. 10 shows a front perspective view of the strap of FIG. 9 as used.
Figure 11:
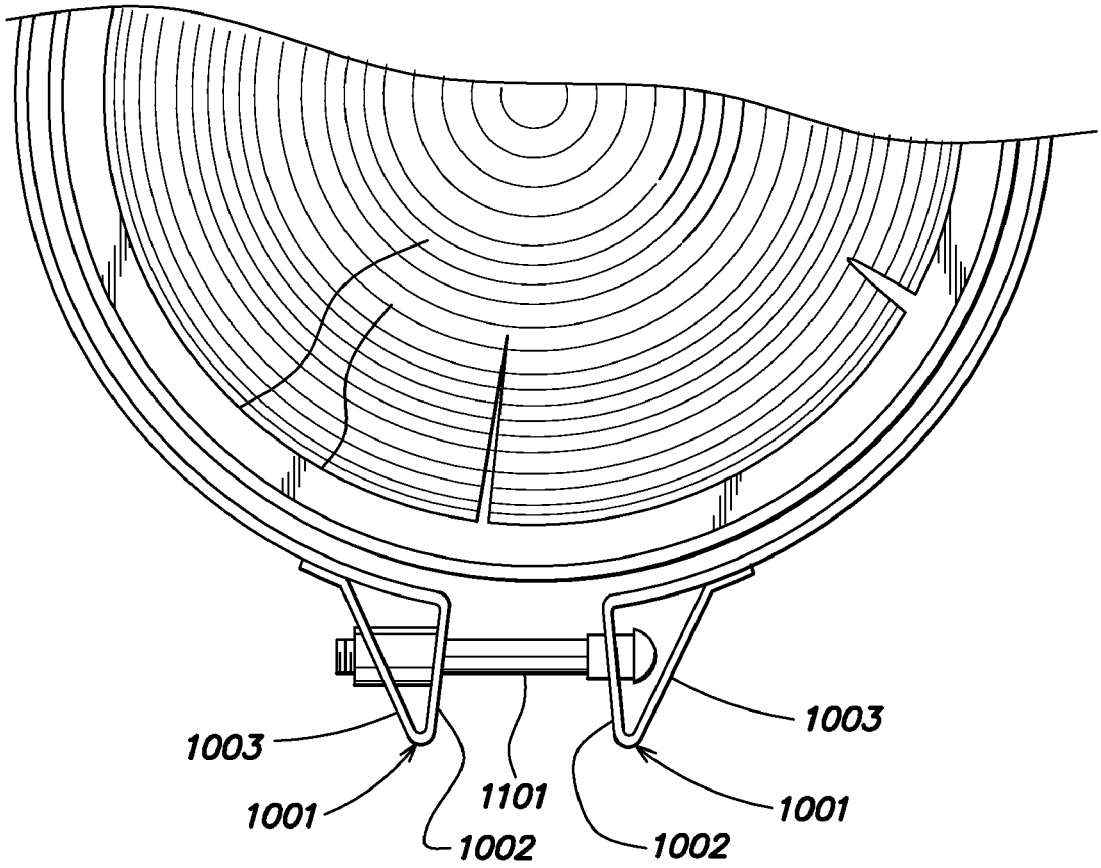
FIG. 11 shows a top view of the strap of FIG. 9 as bolted in place.
Figure 12:
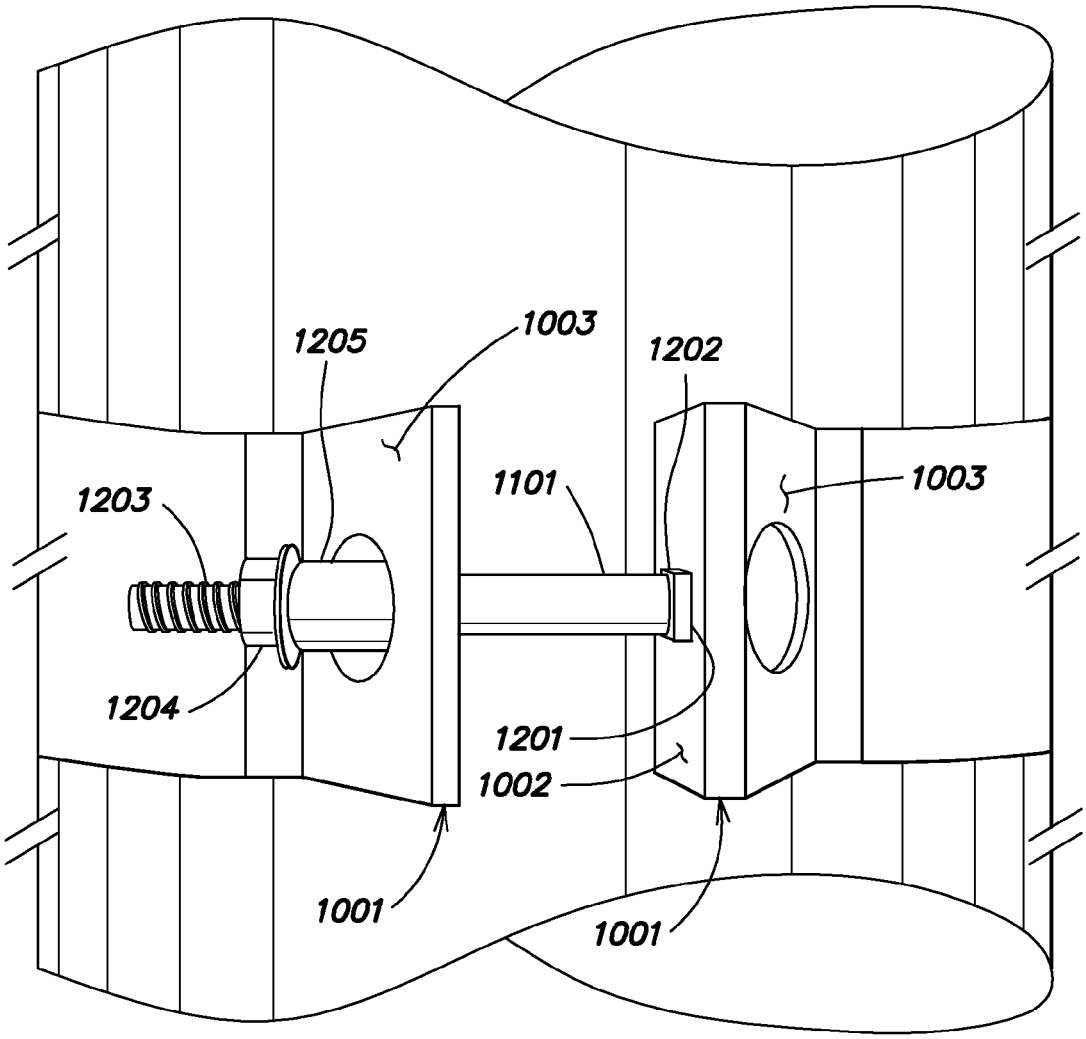
FIG. 12 shows a front view of the strap of FIG. 9 and the bolt system by which it is cinched tight.

The opposite end of each strip is bent to form a generally triangular flange 1001 as shown in FIGS. 10, 11 and 12. The flanges each have one face 1002 with a hole through which a carriage bolt 1101 is passed to cinch the clamp. At least one of the holes is square 1201, to receive the square shank 1202 of the carriage bolt 1101. The threaded end 1203 of the carriage bolt 1101 is received through the hole in the other bracket face, through a flanged spacer 1205 and captured by a flange nut 1204. When the clamp strap has been adjusted to the correct length, the clamp applied to the system and the cinching bolt tightened, the faces of the flanges 1001 will lie parallel, about 1–2 inches apart. The flanged spacer allows an installer to apply a wrench to the nut 1204 without interfering with brace 1003.

The arrangement including the flanges 1001, the flanged spacer 1205 and the flange nut 1204 have been found to make assembly easier by aligning the components without significant effort by the assembler, while also distributing well the clamping forces though the clamp, however, any suitable cinching mechanism could also be used.

The system described is installed as now described.

Suppose, for the sake of this example, that a pole has received damage about 4–5 feet above the ground level. The installer might select a 4 foot sleeve, depending on the extent of the damage. The sleeve is stood on the ground adjacent the pole, with the axial opening facing the pole. The installer then pushes or kicks one end of the sleeve onto the pole and slides the sleeve the rest of the way onto the pole. The sleeve, which weighs about 71 pounds, can then be lifted by the installer to a position where the damage is approximately centered between the ends of the sleeve. Using his body weight, the installer can then stabilize the sleeve against the pole (the high coefficient of friction of the elastic member makes this easier) while the installer hammers home a first and then a second duplex nail. Next, the installer applies a ratchet strap to close the sleeve around the pole. Clamps are then positioned about 1 foot from each end, with the openings of the clamps out of alignment with the axial opening by about 45–90 degrees. The clamps are finally tightened to about 35–60 foot-pounds of torque using a torque wrench, or until a firm resistance is met if a torque wrench is unavailable. A more badly split pole will require higher torque values to close up the split.

The system can be unbolted and removed, and most of the components reused on another stabilization. To remove the system, the uninstaller should first apply a ratchet strap around the sleeve to secure the sleeve. Without the ratchet strap, when the bolts are undone, the spring force of the sleeve can create a hazard by ejecting parts of the system at high rates of speed. However, once the sleeve is properly strapped, the clamp bolts can be loosened and removed, together with the clamps. The sleeve can be gently lowered by a hoist or crane, or by simply slowly loosening the strap. Allowing the sleeve to fall in an uncontrolled manner can be hazardous due to the weight, at 71 pounds per 4 foot section, and thin edge. Once used once, the bolts, nuts and nails are not reusable.

Several additional variations and other concepts should be noted.

The system can be pre-installed on new poles before they are installed in the ground at any convenient location desired to protect the pole against damage. The system can be pre-installed at a level below ground or above ground, depending on the conditions desired to be protected against. For example, the system can be installed at a level to protect from snowplow damage, or below ground where it can protect from insect and water damage. When installed below ground, the entire pole and system portion inserted in the ground can further be encased in concrete. Moreover, the system can be used in construction and marine applications where the system is buried, encased in concrete or below the waterline. For example, the system may be used to stabilize piers.

The system can be used in connection with mounting heavy apparatus to a pole, such as mounting transformers to utility poles. The sleeve can further include brackets welded or bolted on, which in turn receive the brackets customarily used on pole-mounted electrical transformers. The brackets of the apparatus could alternatively be clamped directly to the sleeve using clamping straps such as used to attach the sleeve. Because the system spreads the force of mounting the apparatus over a larger area of the pole, the apparatus and its mounting is less susceptible to damage by harmonic oscillation, shock, shear, and torsion, which can otherwise cause such heavy apparatus to fall, creating a severe crushing hazard when a pole is struck by a vehicle, for example. In this type of application, in order to prevent electrical arcing, the sleeve is preferably coated with a non-conductive polymer coating.

The bolts, nuts and nails can be part of a kit of parts, together with the sleeve, elastic member and clamp straps. High strength duplex nails should be used. All of the metal parts, including the steel, the bolts and the nuts should be certified as to their gauge and strength. The sleeve and clamp straps should be marked with the sizes of poles for which they are suitable. The marking should preferably be in terms of the circumference of the pole at the installation location, as this value is easily measured with a flexible tape measure at the job site.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A pole stabilization and support system for application to a pole, the system comprising:

a metal sleeve that generally conforms to an outer surface of the pole;

an elastic liner disposed between the metal sleeve and the pole, the elastic liner having a pair of generally longitudinal edges; and a clamping band that circumscribes and compresses the metal sleeve which compresses the elastic liner against the pole; wherein the generally longitudinal edges remain spaced apart defining a longitudinal gap therebetween when the elastic liner is compressed against the pole.

2. The system of claim 1, wherein the metal sleeve further comprises:

a generally flat back portion.

3. The system of claim 2, wherein the metal sleeve further comprises:

two generally arcuate wings, one disposed to each side of the generally flat back portion.

4. The system of claim 3, wherein the generally arcuate wings comprise a series of adjacent linear breaks separated by narrow flats.

5. The system of claim 3, wherein one of the generally arcuate wings further comprises a bevel lip bent at an angle inwardly and the other of the generally arcuate wings comprises a generally unbent slip lip, whereby when the sleeve is applied, the slip lip passes over the bevel lip at an overlap.

6. The system of claim 1, further comprising at least one nail hole defined through the sleeve, the nail hole for receiving a nail whereby the sleeve is temporarily suspended during installation.

7. The system of claim 1, further comprising at least one lifting slot defined through the sleeve whereby the sleeve is lifted to an installation location.

8. The system of claim 1, further comprising at least one grounding hole defined through the sleeve, the grounding hole for receiving an earth ground.

9. The system of claim 1, wherein the sleeve is at least about 2 feet long.

10. The system of claim 9, wherein the sleeve is up to about 4 feet long.

11. The system of claim 9, wherein the sleeve is up to about 6 feet long.

12. The system of claim 9, wherein the sleeve is up to about 8 feet long.

13. The system of claim 9, wherein the sleeve is up to about 12 feet long.

14. The system of claim 1, wherein the sleeve further comprises weather resistant steel.

15. The system of claim 14, wherein the weather resistant steel is stainless steel.

16. The system of claim 14, wherein the weather resistant steel is galvanized steel.

17. The system of claim 14, wherein the weather resistant steel is powder coated steel.

18. The system of claim 14, wherein the weather resistant steel is polymer coated steel.

19. The system of claim 1, wherein the elastic liner has about a 50–80 durometer.

20. The system of claim 1, wherein the elastic liner has a coefficient of friction sufficient to hold the system in place when clamped to a pole.

21. The system of claim 1, wherein the elastic liner is about ¾ inches thick.

22. The system of claim 1, wherein the elastic liner is resistant to natural deteriorating agents.

23. The system of claim 22, wherein the elastic liner is sufficiently porous to permit water to flow through the elastic liner.

24. The system of claim 22, wherein the elastic liner is resistant to biologic action.

25. The system of claim 24, wherein the elastic liner is resistant to insect damage.

26. The system of claim 24, wherein the elastic liner is resistant to bacteriologic damage.

27. The system of claim 24, wherein the elastic liner is resistant to fungal damage.

28. The system of claim 24, wherein the elastic liner comprises bonded crumb rubber.

29. The system of claim 1, wherein the clamp is adjustable to accommodate poles having different circumferences and perimeter lengths.

30. The system of claim 29, wherein the generally arcuate wings meet at a joint or opening, and wherein the clamp has an opening drawn together by an adjustable fastener, the opening of the clamp and the joint or opening being unaligned when assembled.

31. The system of claim 1, wherein the clamp is weather resistant.

32. The system of claim 31, wherein the clamp further comprises powder coated steel.

33. The system of claim 31, wherein the clamp further comprises polymer coated steel.

34. A stabilization or support kit comprising:

a sleeve having a generally longitudinal opening opposite a generally flat rear wall, the generally flat rear wall framed on two sides by generally arcuate side walls, the sleeve lined by an elastic layer, the elastic liner having a pair of generally longitudinal edges; and a clamping band having an adjustable circumference that, in use, will be placed to circumscribe and compress the metal sleeve which compresses the elastic liner against the pole; wherein the generally longitudinal edges remain spaced apart defining a longitudinal gap therebetween when the elastic liner is compressed against the pole.

35. The kit of claim 34, wherein the generally arcuate wings comprise a series of adjacent linear breaks separated by narrow flats.

36. The kit of claim 34, wherein one of the generally arcuate wings further comprises a bevel lip bent at an angle inwardly and the other of the generally arcuate wings comprises a generally unbent slip lip, whereby when the sleeve is applied, the slip lip passes over the bevel lip at an overlap.

37. The kit of claim 34, further comprising at least one nail hole defined through the sleeve, the nail hole for receiving a nail whereby the sleeve is temporarily suspended during installation.

38. The kit of claim 34, further comprising at least one lifting slot defined through the sleeve whereby the sleeve is lifted to an installation location.

39. The kit of claim 34, further comprising at least one grounding hole defined through the sleeve, the grounding hole for receiving an earth ground.

40. The kit of claim 34, wherein the sleeve is at least about 2 feet long.

41. The kit of claim 40, wherein the sleeve is up to about 4 feet long.

42. The kit of claim 40, wherein the sleeve is up to about 6 feet long.

43. The kit of claim 40, wherein the sleeve is up to about 8 feet long.

44. The kit of claim 40, wherein the sleeve is up to about 12 feet long.

45. The kit of claim 34, wherein the sleeve further comprises weather resistant steel.

46. The kit of claim 45, wherein the weather resistant steel is stainless steel.

47. The kit of claim 45, wherein the weather resistant steel is galvanized steel.

48. The kit of claim 45, wherein the weather resistant steel is powder coated steel.

49. The kit of claim 45, wherein the weather resistant steel is polymer coated steel.

50. The kit of claim 34, wherein the elastic liner has about a 50–80 durometer.

51. The kit of claim 34, wherein the elastic liner has a coefficient of friction sufficient to hold the system in place when clamped to a pole.

52. The kit of claim 34, wherein the elastic liner is about ¾ inches thick.

53. The kit of claim 34, wherein the elastic liner is resistant to natural deteriorating agents.

54. The kit of claim 53, wherein the elastic liner is sufficiently porous to permit water to flow through the elastic liner.

55. The kit of claim 53, wherein the elastic liner is resistant to biologic action.

56. The kit of claim 55, wherein the elastic liner is resistant to insect damage.

57. The kit of claim 55, wherein the elastic liner is resistant to bacteriologic damage.

58. The kit of claim 55, wherein the elastic liner is resistant to fungal damage.

59. The kit of claim 55, wherein the elastic liner comprises bonded crumb rubber.

60. The kit of claim 34, wherein the clamp is adjustable to accommodate poles having different circumferences and perimeter lengths.

61. The kit of claim 60, wherein the generally arcuate wings meet at a joint or opening, and wherein the clamp has an opening drawn together by an adjustable fastener, the opening of the clamp and the joint or opening being unaligned when assembled.

62. The kit of claim 34, wherein the clamp is weather resistant.

63. The kit of claim 62, wherein the clamp further comprises powder coated steel.

64. The kit of claim 62, wherein the clamp further comprises polymer coated steel.

65. The kit of claim 34, further comprising:

one or more additional sleeves, elastic liners and clamping bands, each having a different length or circumference.

* * * * *